US005587017A

United States Patent [19]

Yamanaka et al.

[11] Patent Number: 5,587,017

[45] Date of Patent: Dec. 24, 1996

[54] PROCESS AND APPARATUS FOR PRODUCING MOLTEN METAL COATED STEEL SHEETS

[75] Inventors: Shizuo Yamanaka, Chiba-ken; Takao Hashimoto, Ibaragi-ken, both of Japan

[73] Assignee: Sumitomo Metal Industries, Ltd., Osaka, Japan

[21] Appl. No.: 314,630

[22] Filed: Sep. 29, 1994

[30] Foreign Application Priority Data

Sep. 30, 1993 [JP] Japan ..... 5-244749

[51] Int. Cl.[6] ..... B05C 3/00

[52] U.S. Cl. ..... 118/424; 118/429

[58] Field of Search ..... 427/433, 435, 427/434.5; 118/423, 424, 429, 427

[56] References Cited

U.S. PATENT DOCUMENTS

| | | | |
|---|---|---|---|
| 656,501 | 8/1900 | Braddock | 118/423 |
| 928,385 | 7/1909 | Huxley | 118/429 |
| 2,224,578 | 12/1940 | Weam et al. | 118/422 |
| 2,690,005 | 9/1954 | Schoenfeld, Jr. | 118/429 |
| 2,702,525 | 2/1955 | Whitfield | 118/423 |
| 2,742,019 | 4/1956 | Queer, Sr. | 118/423 |
| 3,881,329 | 5/1975 | Passler et al. | 118/428 |
| 4,275,098 | 6/1981 | Gunji et al. | 118/429 |

*Primary Examiner*—Brenda A. Lamb

*Attorney, Agent, or Firm*—Burns, Doane, Swecker & Mathis, LLP

[57] ABSTRACT

A steel sheet is plated with a molten metal in a plating tank. A buffer member is provided between a sink roll submerged in the melt in the plating tank and the side wall of tank at its delivery end from which the plated steel sheet emerges. During plating, the buffer member decelerates the melt flows coming from below the sink roll so as to settle the suspended dross in the melt. The buffer member may be in the form of a rod or a plate. If desired, it may be combined with a shield plate provided below the sink roll or a raised portion formed on the bottom of the plating tank.

16 Claims, 10 Drawing Sheets

PROCESS AND APPARATUS FOR PRODUCING MOLTEN METAL COATED STEEL SHEETS

BACKGROUND OF THE INVENTION

The present invention relates to a process and apparatus for producing steel sheets provided with molten metal coatings by the continuous hot-dip plating method. More specifically, the invention relates to a process and apparatus for producing coated steel sheets in which the sedimentation of dross or impurities that are formed and suspended in the melt during hot-dipping is effectively promoted to yield coatings of good quality without dross defects.

The conventional continuous hot-dip plating method for producing steel sheets coated with molten metal (referred to below as molten metal coated steel sheets) consists of applying a preliminary treatment to a steel sheet through a continuous furnace, dipping the steel sheet in a plating bath, and passing it through the bath. A brief description of this method is given below with molten zinc as an example of a molten metal.

FIG. 1 is a schematic diagram showing the conventional production process. As shown, a plating tank 1 is continuously supplied with a steel sheet 2 via a snout 6 after the sheet 2 has been subjected to a surface activation treatment in a continuous furnace (not shown). The steel sheet 2 is passed around a sink roll 3 submerged in the plating bath so that it ascends through the bath and passes between snap rolls 4 and is subsequently drawn out of the bath.

When a molten metal is molten zinc, this process is called hot galvanizing. In this process of hot galvanizing, Fe dissolving out of the steel sheet combines chemically with Al and Zn to form dross (or impurities) principally composed of $FeZn_7$ and $Fe_2Al_5$ as indicated by dots in FIG. 1. Generally speaking, $FeZn_7$ deposits as bottom dross 5 on the bottom of the plating tank, whereas $Fe_2Al_5$ floats as top dross 9 on the surface of the melt in the plating bath. In actual operations, the rotation of the sink roll 3 and other submerged members creates currents, which cause part of the bottom dross 5 to become suspended in the plating bath or melt as indicated by arrows in FIG. 1.

Top dross 9 floats on the surface of the melt and can be removed with a screen, which is the most common method currently used in practice. On the other hand, the dross suspended in the plating bath is difficult to remove and unavoidably adheres to the surface of the steel sheet, thereby reducing the quality of a molten metal coating. In an extreme case, the coated steel sheet has to be discarded as scrap because of unacceptable quality.

However, the very nature of the continuous hot galvanizing method makes it impossible to prevent the formation of dross. Instead, recent efforts in the plating industry are directed to reducing the suspension of dross due to the currents created by the rotation of the sink roll and other submerged members. To this end, the depth of the plating tank is sufficiently increased to reduce the adverse effects of the currents on the bottom dross. This approach has proved reasonably successful in reducing the suspension of dross.

Increasing the depth of the plating tank is indeed effective in reducing the suspension of dross, but on the other hand, a greater amount of plating bath is necessary and the energy costs for the maintenance and control of the bath increase accordingly, as does the operational difficulty in removing the bottom dross. Another problem with this approach is that it cannot be applied to existing plating tanks, which must be reconstructed at significant cost to increase their depth.

SUMMARY OF THE INVENTION

An object of the present invention is to provide a method for producing molten metal coated steel sheets that employs convenient and effective means to reduce the deposition of dross on the final product.

Another object of the invention is to provide an apparatus for implementing this method.

The present inventors conducted intensive studies of hydrodynamic phenomena in plating tanks in order to reduce the suspension of bottom dross and made the following observations, as shown in detail in FIG. 1.

(1) A dross defect is a phenomenon that develops when the dross suspended in the melt in the plating tank adheres to the surface of a steel sheet and remains in a coating even after finishing hot-dipping by gas wiping and other methods.

(2) Dross held between the sink roll and the steel sheet is pressed in the decreasing nip so that it adheres firmly enough to prevent effective removal by wiping.

(3) The problems produced by bottom dross are mainly due to bottom dross of a comparatively large size (approximately 100 μm), which settles on the bottom during shutdown. When the plating operation is restarted, however, this dross becomes suspended in the melt by the lifting action of the currents that are created by the motion of the sink roll and other submerged rotating members, as well as by the steel sheet.

(4) The concomitant, submerged currents primarily move from the feed end of the plating tank to the delivery end in the direction of sheet movement. After the dross is lifted below the sink roll, it repeatedly bumps against the side wall of the plating tank, goes up through the melt, and is stirred by the submerged rotating members together with the suspended dross, so that it circulates through the melt in the plating tank.

The present invention, which is capable of performing continuous plating with molten metals, has been accomplished on the basis of these findings.

According to a first aspect, the present invention provides a process for producing a molten metal coated steel sheet by applying a molten metal coating to a steel sheet that is continuously admitted through a hot-dip plating bath as the sheet is passed around a submerged sink roll. The adhesion of dross to the surface of the coated steel sheet is reduced by decelerating melt flows coming from below the sink roll to allow suspended dross to settle by means of a buffer member provided between the sink roll and a side wall of the molten metal plating tank at the delivery end from which the coated steel sheet emerges.

In a preferred embodiment, the buffer member may be combined with a current suppressing member such as a shield plate provided between the sink roll and the bottom of the molten metal plating tank and/or a raised portion formed on the bottom of the molten metal plating tank in an area located below the sink roll. As a result, melt flows coming from below the sink roll and, hence, the lifting and suspension of the bottom dross are suppressed during the hot-dipping of the steel sheet.

According to a second aspect, the present invention provides an apparatus for producing a molten metal coated steel sheet which comprises a molten metal plating tank, a sink roll submerged in a molten metal plating bath, and a buffer member provided between the sink roll and the side wall of the molten metal plating tank at the delivery end from which the coated steel sheet emerges and which is capable of decelerating melt flows coming from below the sink roll.

In a preferred embodiment, the apparatus may further include a current suppressing member such as a shield plate provided between the sink roll and the bottom of the molten metal plating tank and/or a raised portion formed on the bottom of the molten metal plating tank in an area located below the sink roll. These additional members suppress melt flows coming from below the sink roll and, hence, the lifting and suspension of the bottom dross collecting on the bottom of the plating tank.

DESCRIPTION OF PREFERRED EMBODIMENTS

The operation of the present invention is described below more specifically with reference to accompanying drawings.

Figure 1:
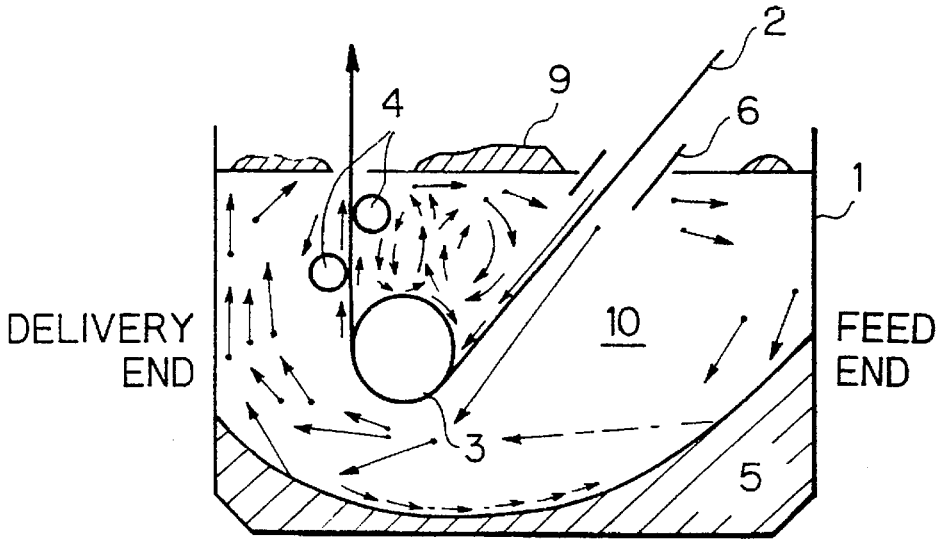
Fig. 1 PRIOR ART
FIG. 1 is a schematic diagram showing the directions of currents created in a molten metal plating tank used in the prior art.
Figure 2:
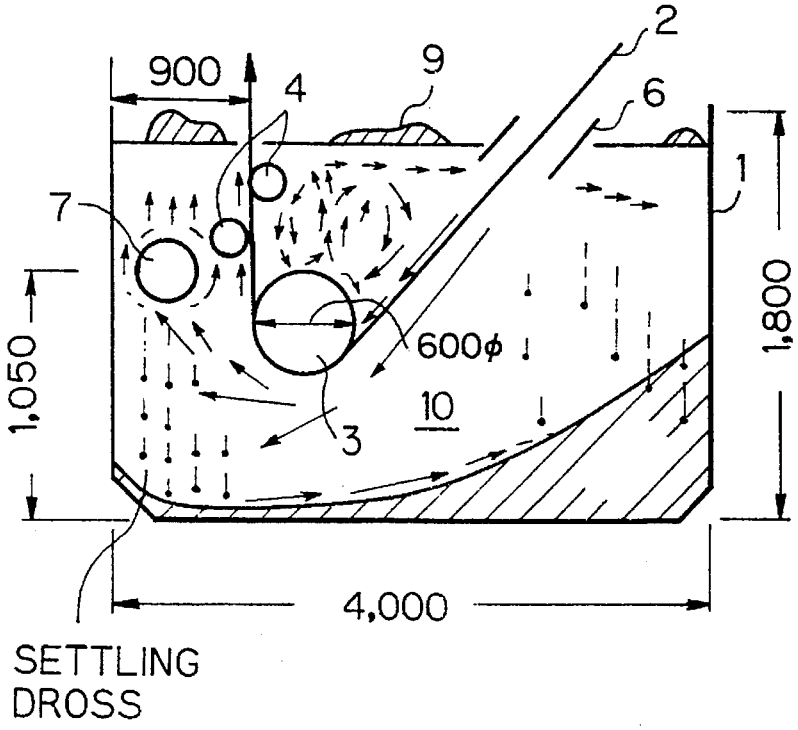
FIG. 2 is a schematic diagram showing the directions of currents created in a molten metal plating tank in accordance with the present invention.

FIG. 2 is a schematic diagram outlining the motion of currents created in a molten metal plating bath used in the invention. As shown, bottom dross 5 generated in the plating bath is lifted by currents created by the movements of steel sheet 2. The movements include dipping in the plating bath (chiefly made of molten Zn), changing the direction of sheet pass, and recovering the steel sheet from the plating bath. Currents are also created by the rotation of submerged rolls, namely, sink roll 3 and snap rolls 4, and the thus lifted bottom dross is suspended in the plating bath. The suspended dross will adhere to the surface of the steel sheet (also see FIG. 1). The numerals in FIG. 2 other than those used to identify various parts and components refer to dimensions in millimeters.

According to the invention, a buffer member 7 of an appropriate shape (which may be a cylinder or a polygonal prism) is provided between the side wall of the plating tank at the steel sheet delivery end and the sink roll so that the direction of ascending currents is changed to promote the sedimentation, i.e., settling of the suspended dross. The currents that create the movement of suspended dross occur in various directions as indicated by arrows in FIG. 2, while settling dross is indicated by dots and dashed lines.

FIGS. 3*a* to 3*d* are schematic perspective views showing four examples of shapes of the buffer member used in the present invention. The numerals in these figures represent the dimensions of the buffer members in millimeters.

Figure 3A:
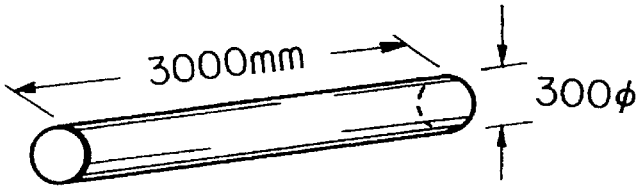
FIG. 3*a* to 3*d* are schematic perspective views showing four shapes of a rod-shaped buffer member for use in the present invention.
Figure 3B:
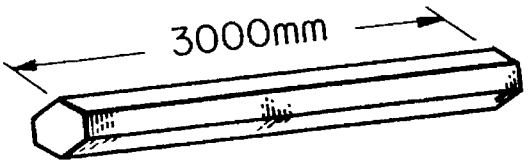
Figure 3C:
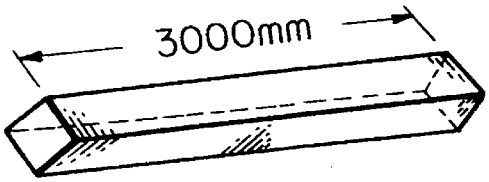
Figure 3D:
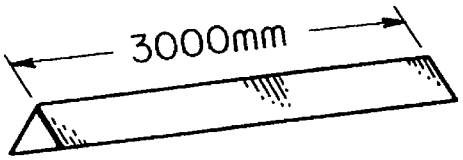

FIG. 3*a* shows the case where the buffer member is comprised of a rod having a circular cross section. The buffer member may be a hollow part having two open ends or two closed ends or one closed and one open end. FIG. 3*b* shows the case where the buffer member is a rod having a polygonal cross section, e.g., hexagonal cross section. FIG. 3*c* shows the case where the buffer member is a rod having a rectangular cross section. FIG. 3*d* shows the case where the buffer member is a rod having a triangular cross section.

Figure 4:
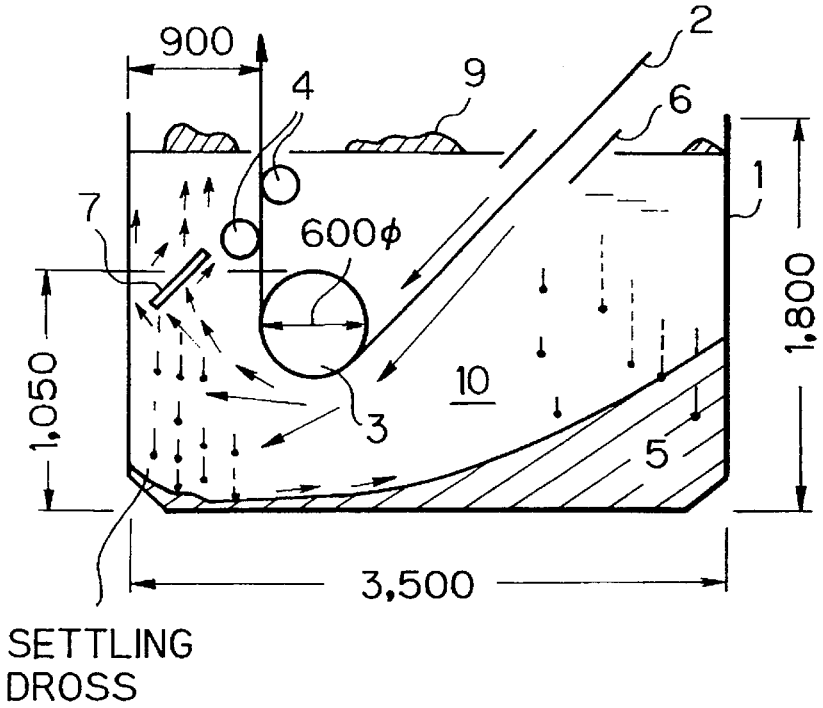
FIG. 4 is a schematic diagram showing the directions of currents created in another example of a molten metal plating tank in accordance with the present invention.
Figure 5:
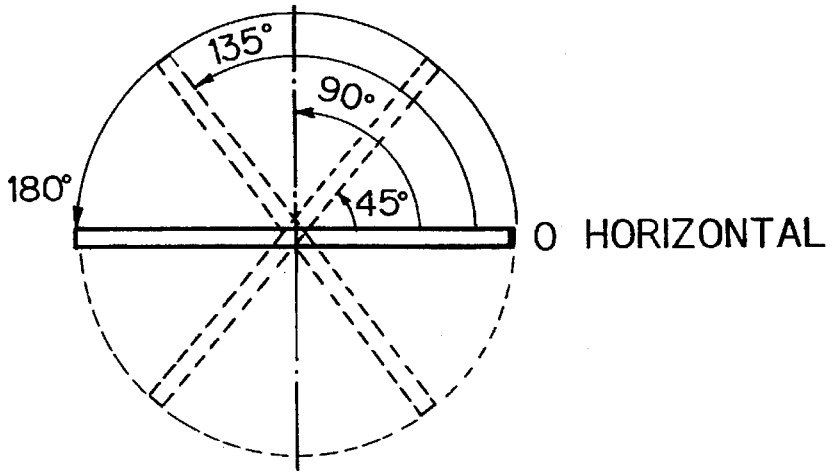
FIG. 5 is a diagram illustrating the range of mounting angles through which a plate-shaped buffer member of the invention can be adjusted.

FIG. 4 is a schematic diagram showing the directions of currents created in a molten metal plating bath used in another embodiment of the invention, in which the buffer member 7 is plate-shaped. Such a buffer member may be installed in such a way that the angle of its upper and lower surfaces is variable, as shown in FIG. 5.

FIGS. 6*a* to 6*d* are schematic perspective views showing four examples of shapes of a plate-shaped buffer member. The numerals in those figures represent the dimensions of the buffer members in millimeters.

Figure 6A:
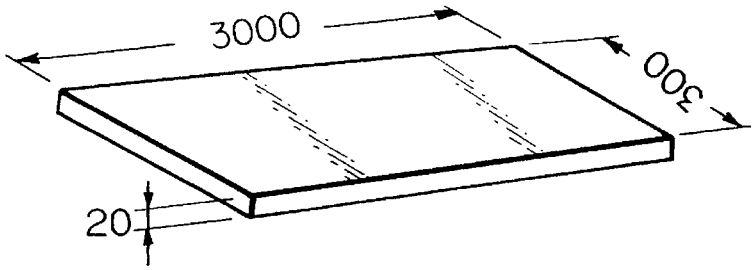
FIGS. 6(*a*) to 6(*d*) are schematic perspective views showing four shapes of a plate-shaped buffer member.
Figure 6B:
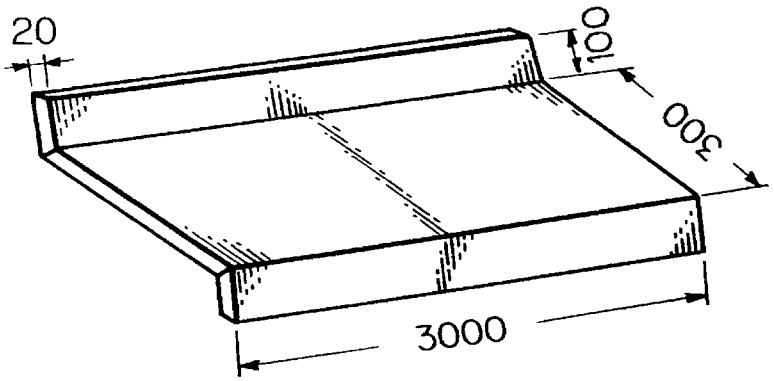
Figure 6C:
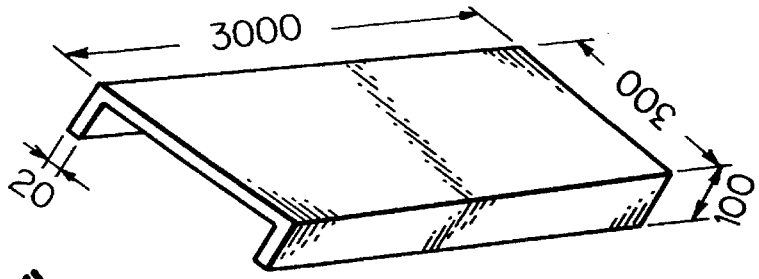
Figure 6D:
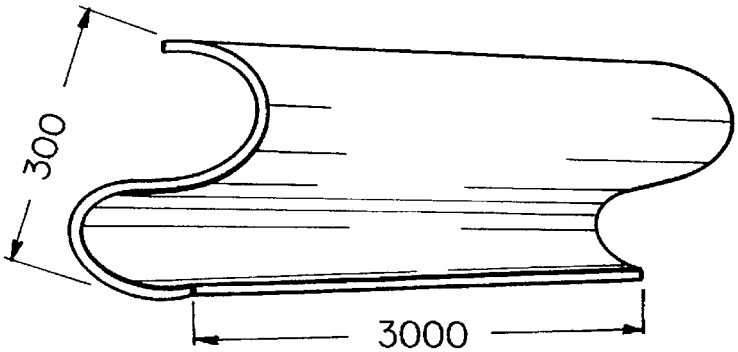

FIG. 6*a* shows an example where the buffer member is a simple flat plate. FIG. 6*b* shows an example where the buffer member is a plate with flanges extending in opposite directions from opposite lengthwise edges. FIG. 6*c* shows an example in which the buffer member is a channel-shaped plate with flanges extending in the same direction from opposite lengthwise edges. FIG. 6*d* shows an example in which the buffer member is a curved plate having an S-shaped transverse cross section.

According to a preferred embodiment of the present invention, a buffer member of an appropriate shape selected from the examples shown in FIGS. 3*a* to 3*d* and FIGS. 6*a* to 6*d* is provided between the side wall of the plating tank at the steel sheet delivery end and the sink roll.

As above-mentioned, the buffer member is preferably provided somewhere in the area between the sink roll and the side wall of the molten metal plating tank at the delivery end from which the plated steel sheet emerges. If the buffer member is rod-shaped, the position of the sink roll, i.e., its height from the bottom of the plating tank and its distance from the side wall should be taken into account in determining the location of the buffer member, and preferably it is positioned between the sidewall of the plating tank and the sink roll, with the top surface of the sink roll being in substantial alignment with the center of the buffer member. If the buffer member is plate-shaped, it is preferably positioned in such a way that its center of area is in substantial alignment with the top surface of the sink roll.

However, depending on the speed at which the steel sheet is passed, best results may not be attained even if the center of the buffer member 7 is brought into alignment with the top surface of the sink roll. For instance, in Examples 2 and 5, described later, the best results were attained when the center of the buffer member 7 was 100 mm higher than the top surface of the sink roll at a sheet pass speed of 120 m/min.

Thus, as indicated by arrows in FIG. 2, currents rising from below the sink roll are decelerated when their direction is changed temporarily by the buffer member 7. Even if the directional change is abrupt, the melt (plating bath) has no difficulty in creating currents, but the dross is unable to follow the abrupt change and separates from the current and descends in the direction indicated by dashed lines in FIG. 2.

The dross-containing currents that are ascending at the steel sheet delivery end impinge against the buffer member, which is in the form of either a rod or a plate. If the buffer member is installed in such a way that its major surfaces are parallel to the melt level, the direction of these currents will change so sharply (through an acute angle) that they interfere with other currents created by the rotating sink roll, and the resulting local enhancement of the stirring action will cause part of the suspended dross in the plating tank to ascend. Another possibility is the shortening of the time (or distance) of contact between the buffer member and the currents. Whichever the case may be, the sedimentation of the suspended dross is accelerated.

As it settles the suspended dross passes along the side wall of the plating tank and rests on the bottom of the tank at the steel sheet feed end. As a result, the quantity of the dross that is suspended by the currents decreases sharply.

The state of dross suspension varies with factors such as the speed of sheet pass, the formulation of the plating bath, and its temperature. Therefore, if fine adjustments of the vertical position of the buffer member are made based on the amount of dross deposits on the surface of the coated steel sheet or on the concentration of dross in the plating bath, the cleanliness of the molten metal bath can be further increased.

According to the invention, further improvements can be achieved by providing a shield plate, i.e., a straightening vane between the sink roll and the bottom of the plating tank and/or by forming a raised portion on the tank bottom in an area below the sink roll. The shield plate hereunder sometimes referred to as "straightening vane".

Figure 7:
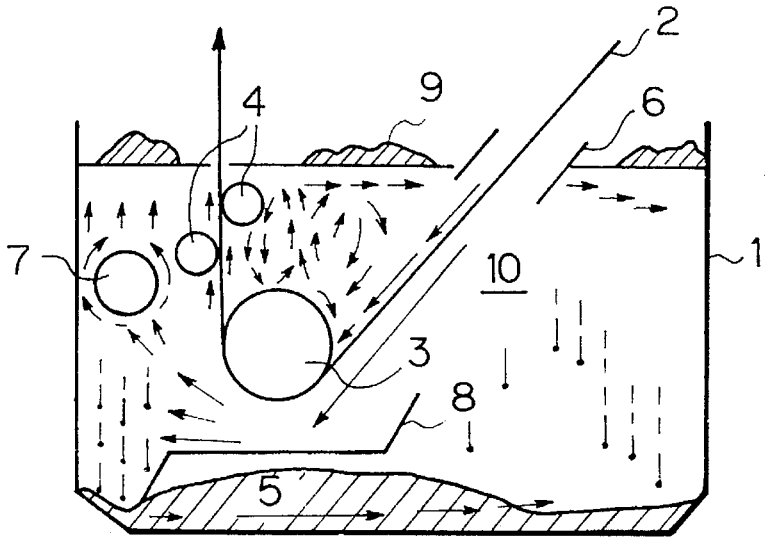
FIG. 7 is a schematic diagram showing an embodiment of the invention in which the buffer member is combined with a straightening vane, i.e., shield plate also provided in the molten metal plating tank.

FIG. 7 shows an embodiment in which a straightening vane 8 is provided above the bottom of the plating tank 1. The vane, or shield plate 8 assures complete isolation of the bottom dross 5 from the area where the steel sheet passes. Therefore, the bottom dross will not be lifted by currents, and the possibility that the bottom dross that has experienced accelerated sedimentation by the buffer member 7 will be lifted again by the currents due to the rotation of the sink roll is reduced.

Figure 8:
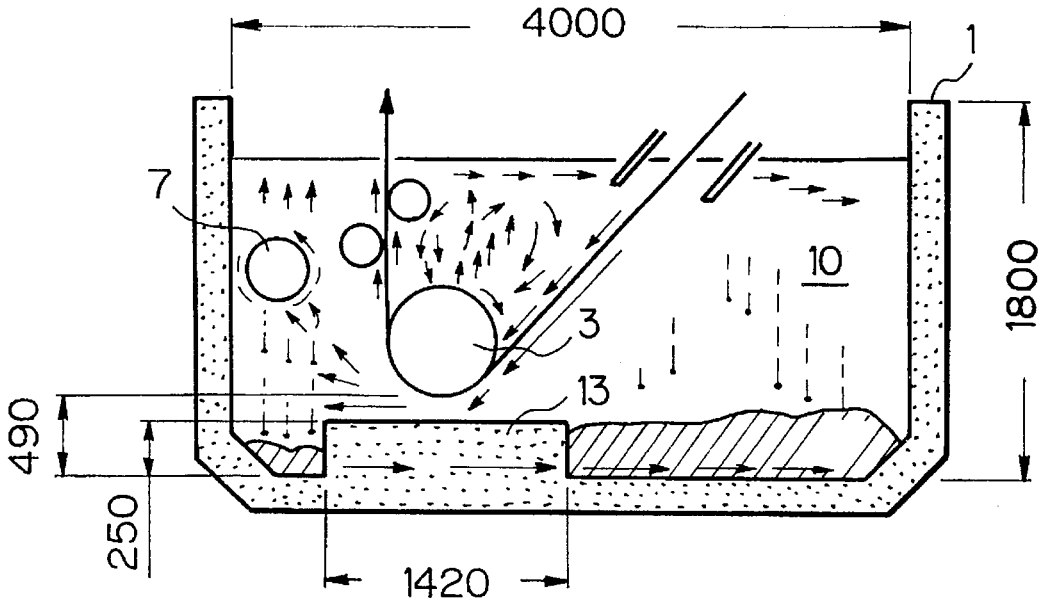
FIG. 8 is a schematic diagram showing another embodiment of the invention in which the buffer member is combined with a raised portion formed on the bottom of the molten metal plating tank.
Figure 9A:
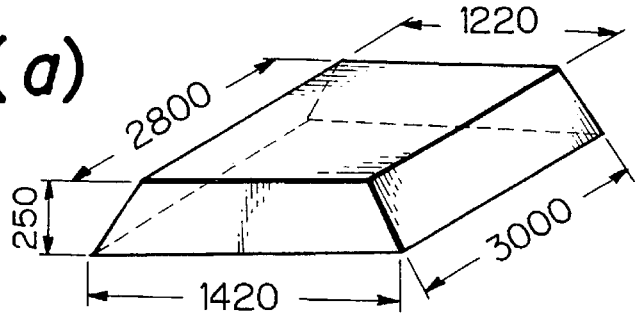
FIGS. 9*a* to 9*c* are schematic diagrams showing three shapes of the raised portion formed on the bottom of the molten metal plating tank.
Figure 9B:
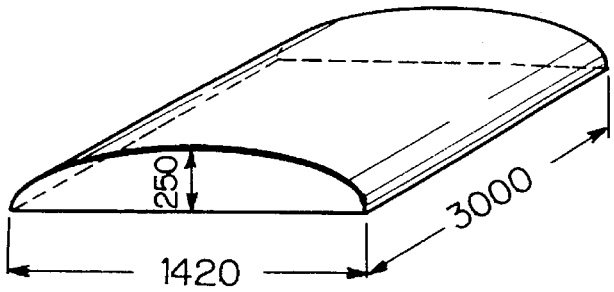
Figure 9C:
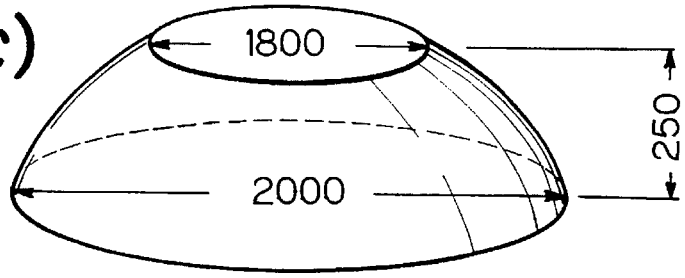

While FIG. 7 shows an embodiment having a straightening vane 8, the same results can be attained by forming a raised portion on the bottom of the plating tank as shown in FIG. 8, which is a simplified sectional view. A raised portion 13 having a rectangular cross section is formed in the plating tank 1 below the sink roll. Three examples of shapes of the raised portion 13 are shown in FIGS. *9a*, *9b*, and *9c*. In these examples, the cross section of the raised portion is respectively trapezoidal, semi-elliptical, and the frustum of a part of a sphere. The numerals in FIGS. *9a–9c* refer to the dimensions of the raised portions in millimeters.

The advantages of the present invention are described below more specifically by means of examples, which are given here for illustrative purposes only and should not be taken as limiting.

EXAMPLES

In these examples, steel sheets were subjected to continuous hot galvanizing under the conditions set forth below using an apparatus of the type shown in FIG. 2. In each example, a buffer member according to the present invention was used either alone or in combination with a straightening vane or a raised portion according to the present invention. To verify the advantages of the invention, the results of hot dipping were compared with those obtained by a prior art method not using any buffer member.

| HOT GALVANIZING CONDITIONS | |
|---|---|
| Steel sheet to be plated | 0.60 $mm^T \times 1200\ mm^W \times L$ |
| Bath formulation | 0.10–0.12% Al and a balance of Zn and impurities |
| Bath temperature | 460 ± 10° C. |
| Sheet pass speed | 100 m/min |
| Plating tank layout | See FIG. 2 |
| Diameter of sink roll | 600 mm; distance from the tank bottom to the roll center = 750 mm (height of the top surface of roll = 1050 mm) |

Hot galvanizing was carried out under the conditions set forth above. After gas wiping, heat treatment was performed to yield hot galvanized steel sheets with alloying.

EXAMPLE 1

In this example, hot galvanizing was conducted under the conditions set forth above using buffer members in the plating tank. For the shapes and dimensions of the respective buffer member, see FIGS. *3a–3d*. The galvanized steel sheets thus produced are designated cases a to d, respectively. Each buffer member was mounted at such a height that the center of the buffer member was 1050 mm from the tank bottom and in substantial alignment with the top surface of the sink roll.

For comparison, hot galvanizing was conducted under the same conditions as above, except that no buffer member was used (prior art case).

Figure 10:
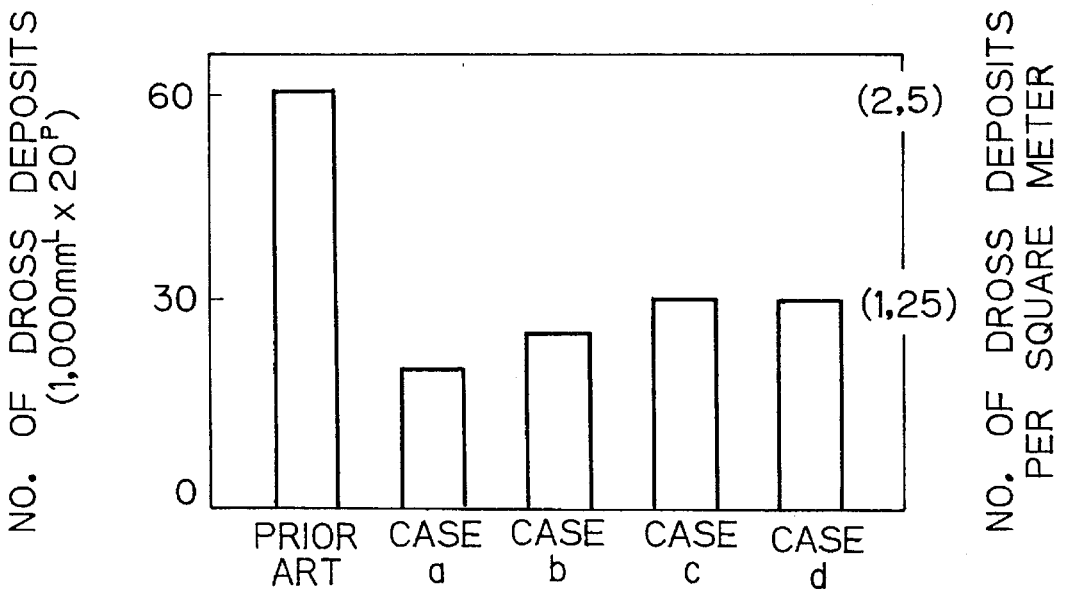
FIG. 10 is a graph showing the number of dross deposits that occurred in Example 1 of the invention and in a prior art example.

The results are shown graphically in FIG. 10 in terms of the number of dross deposits. For data collection, 20 pieces each measuring 1000 mm in length were cut from each sample of galvanized steel sheet across its width and the number of dross deposits on the surface of each piece in contact with the sink roll was counted. A total number of dross deposits for 20 pieces was measured.

As can be seen from FIG. 10, the number of dross deposits on the surface of galvanized steel sheets was at least reduced to one half in the invention, and when a cylindrical buffer member was used as in case a, the decrease was almost to a third.

EXAMPLE 2

In this example, buffer members of the types shown in FIGS. 3*a*–3*d* were used as in Example 1. However, the sheet pass speed was increased to 120 m/min, and the distance from the tank bottom to the center of each buffer member was varied in the vertical direction. The numbers of dross deposits on the surfaces of the respective samples of galvanized steel sheets were referred to as Cases a to d, in which the buffer members of FIGS. 3*a*–3*d* were employed, respectively.

Figure 11:
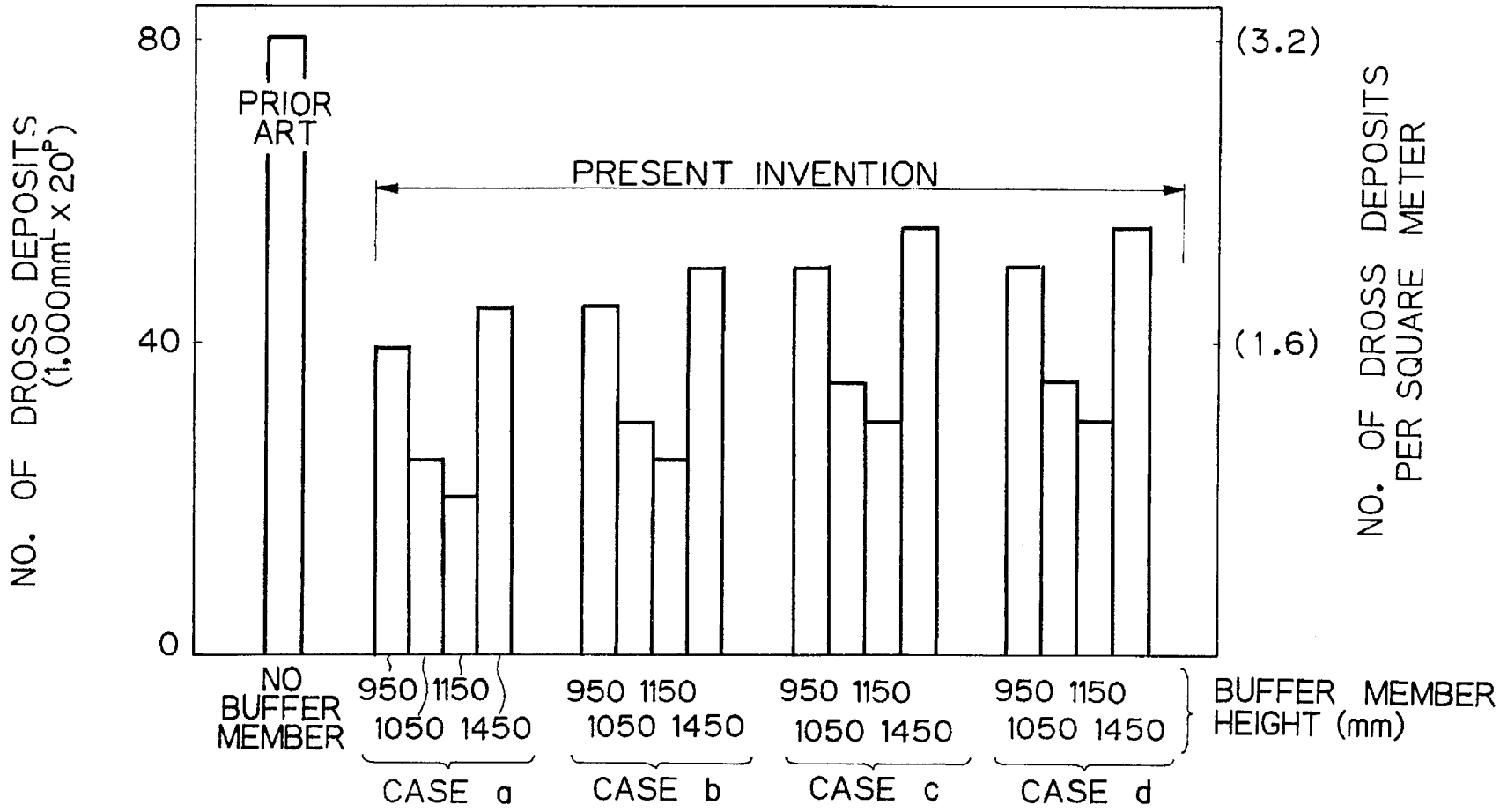
FIG. 11 is a graph showing the quantity of dross deposition that occurred in a prior art example and when the positional setting of the buffer member was varied in Example 2 of the invention.

The results are shown graphically in FIG. 11, from which it can be seen that each of the buffer members could be adjusted in vertical position to obtain an optimal height. It was also clear that each of the four buffer members used in accordance with the present invention contributed to a marked decrease in the number of dross deposits on the surfaces of coated steel sheets as compared to the prior art case.

EXAMPLE 3

The procedure of Example 1 was repeated, except that a buffer member of the cylinder type was used in combination with either a straightening vane provided below the sink roll or a raised portion formed on the bottom of the plating tank. The number of dross deposits on the surfaces of the hot galvanized steel sheets was counted.

Figure 12:
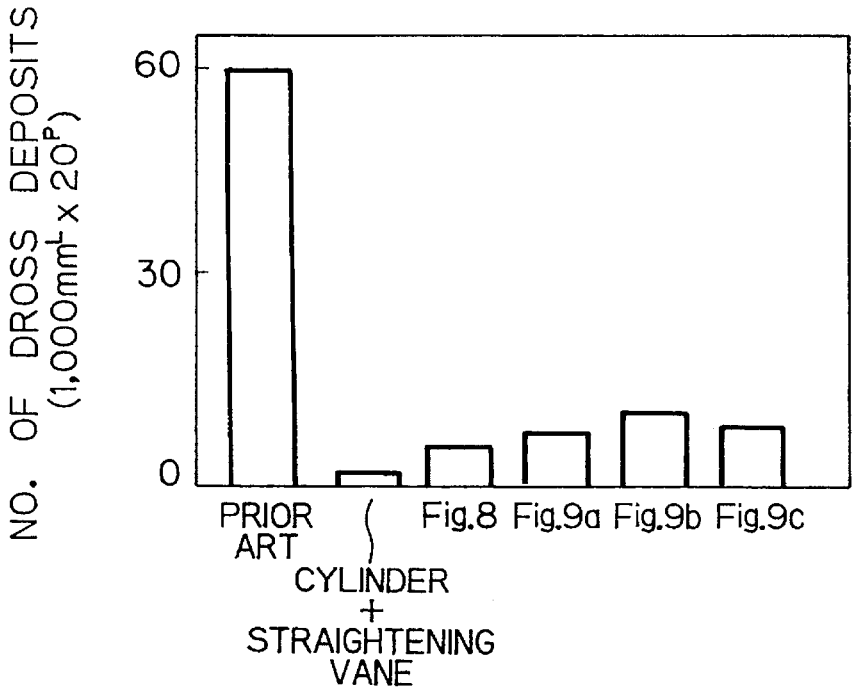
FIG. 12 is a graph showing the profile of dross deposition that occurred in a prior art example and when the buffer member was combined with a straightening vane in Example 3 of the invention.

The results are shown graphically in FIG. 12, from which it is clear that the combined use of the buffer member with the straightening vane or the raised portion produced a synergistic effect which helped further reduce the quantity of dross deposition compared to when the buffer member was used alone.

The case of "cylinder + straightening vane" mentioned in FIG. 12 refers to the tank design illustrated in FIG. 7. The four different shapes of raised portion illustrated in FIGS. 8 and 9*a*–9*c* were used in Example 3.

EXAMPLE 4

The procedure of Example 1 was repeated except that plate-shaped buffer members like those illustrated in FIGS. 6*a*–6*d* were used in a plating tank having the construction shown in FIG. 4.

Figure 13:
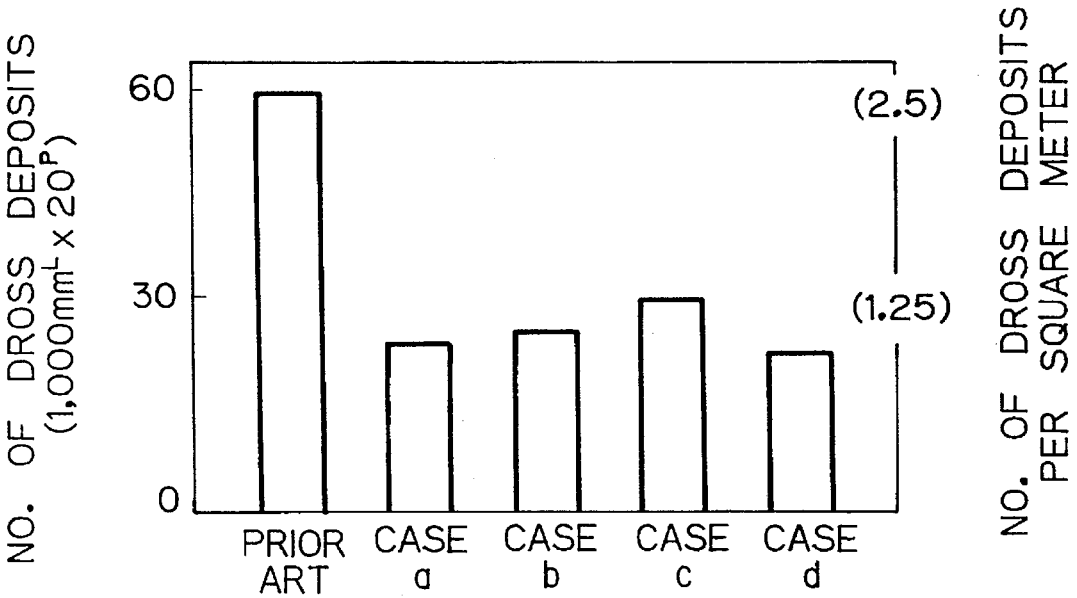
FIG. 13 is a graph showing the number of dross deposits that occurred in Example 4 of the invention and in a prior art example.

The results are shown graphically in FIG. 13. Cases a to d, refer to the use of the buffer members shown in FIGS. 6*a*–6*d*, respectively, and the prior art case refers to a case in which no buffer member was used. The plate-shaped buffer members could clearly achieve the same results as the rod-shaped buffer members.

EXAMPLE 5

Figure 14:
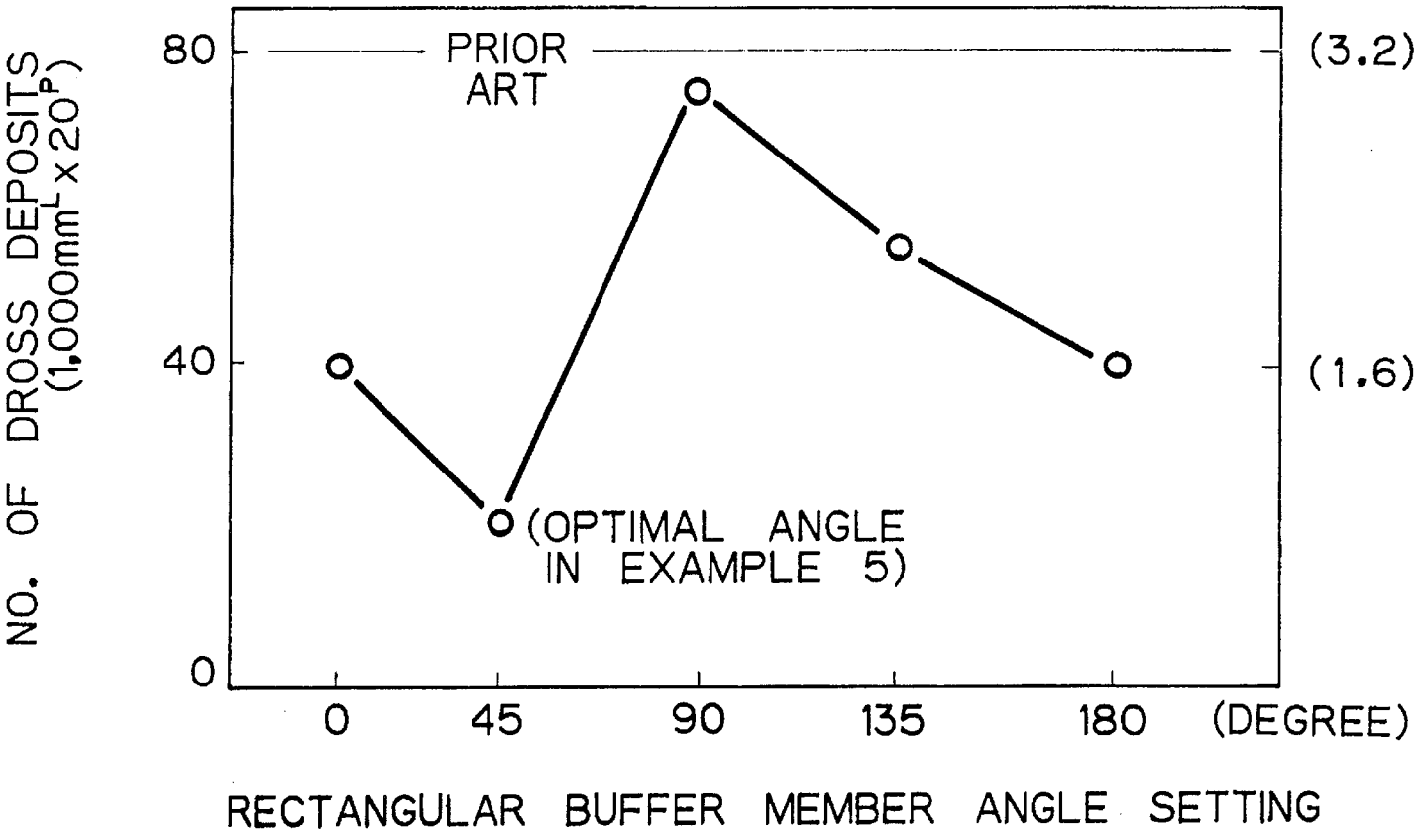
FIG. 14 is a graph showing the quantity of dross deposition that occurred in a prior art example and when the positional setting of the buffer member was varied in Example 5 of the invention.

Hot galvanizing was performed under the same conditions as in Example 4, except that the sheet pass speed was increased to 120 m/min, and the plate shown in FIG. 6*a* was used as a buffer member with the angle of its installation varied from zero to 180 degrees. The number of dross deposits is shown graphically in FIG. 14 as a function of the angle setting. FIG. 14 also shows that 80 dross deposits occurred in the prior art case, in which no buffer member was used.

EXAMPLE 6

Figure 15:
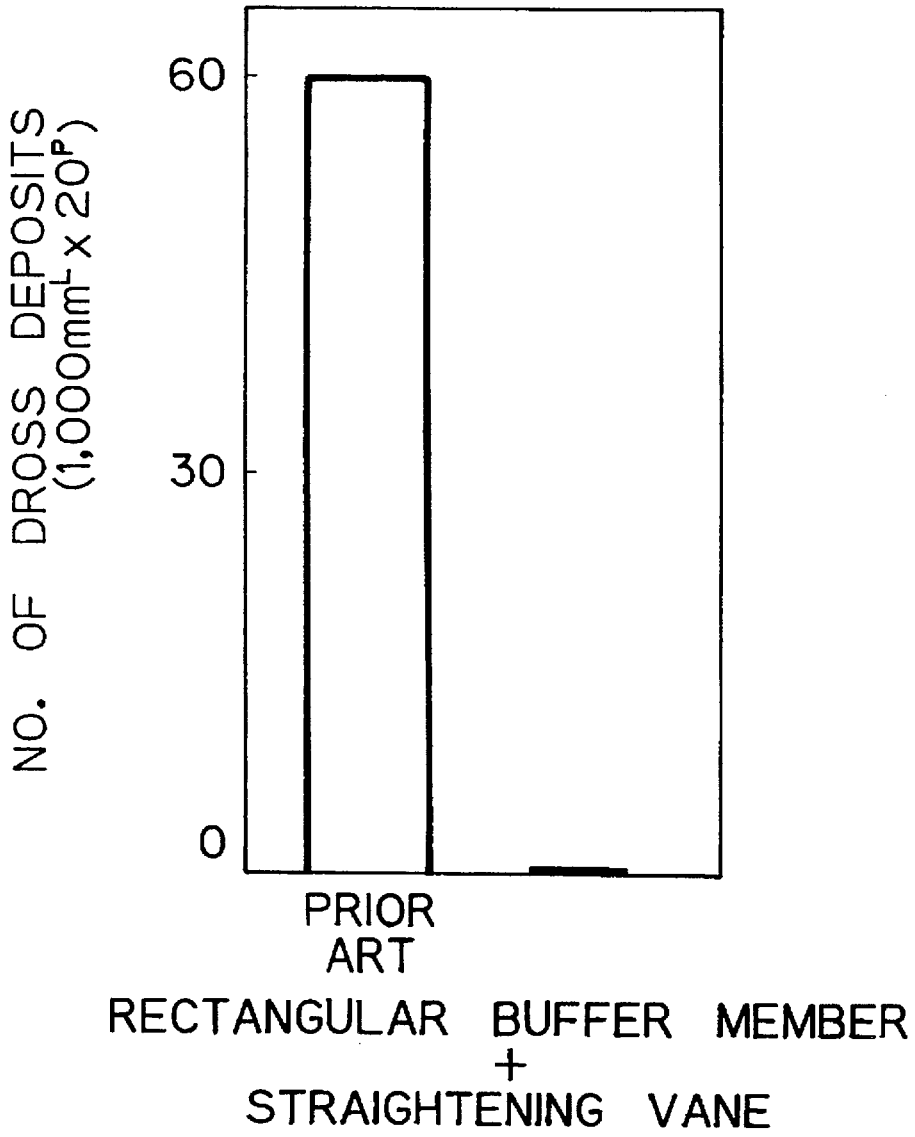
FIG. 15 is a graph showing the profile of dross deposition that occurred in a prior art example and when the buffer member was combined with a straightening vane in Example 6 of the invention.

To verify the synergistic effect of the combination of a plate-shaped buffer member with a straightening vane, hot galvanizing was performed under the same conditions as in Example 4, except that a plate-shaped buffer member shown in FIG. 4 was used in combination with the straightening vane 8 shown in FIG. 7. The number of dross deposits on the galvanized steel sheet was counted, and the result is shown graphically in FIG. 15, which also shows the result of the prior art case which employed neither a straightening vane nor a buffer member. The dross deposition was negligible in the present invention.

According to the present invention, the number of dross deposits that occur in the continuous plating of steel sheets with molten metals can be reduced without increasing the depth of existing plating tanks. Hence, plated steel sheets of good quality can be produced with great ease.

What is claimed is:

1. An apparatus for producing a molten metal plated steel sheet comprising:

a molten metal plating tank containing a melt, said plating tank having a bottom and side walls with one side wall being located at a delivery end at which a steel sheet fed through the plating tank emerges, a submerged sink roll disposed in the plating tank for conveying the steel sheet; and a buffer member provided within the tank between the sink roll and the one side wall for decelerating melt flows coming from below the sink roll.

2. An apparatus according to claim 1 which the buffer member is a plate-shaped buffer member.

3. An apparatus according to claim 2 which the plate-shaped buffer member is a plate installed at an angle with respect to said one wall.

4. An apparatus according to claim 1 wherein the buffer member is a rod-shaped buffer member.

5. An apparatus according to claim 4 wherein the rod-shaped buffer member has a circular cross section.

6. An apparatus according to claim 4 wherein the rod-shaped buffer member has a polygonal cross section.

7. An apparatus according to claim 1 which further includes a current suppressing member.

8. An apparatus according to claim 7 wherein the current suppressing member is a shield plate disposed between the sink roll and the bottom of the tank.

9. An apparatus according to claim 7 wherein the current suppressing member is a raised portion projecting from a bottom of the plating tank.

10. Apparatus according to claim 1, including a plurality of snap rolls disposed in the plating tank above the sink roll.

11. Apparatus for producing a molten metal plated steel sheet, comprising:

a molten metal plating tank for holding melt through which a steel sheet is to be fed, the molten metal plating tank having a delivery end at which a steel sheet fed through the plating tank emerges, said plating tank having a side wall at the delivery end;

a sink roll positioned in the tank around which the steel sheet is to be passed;

and melt flow decelerating means positioned in the plating tank between the sink roll and said side wall for decelerating melt flows from below the sink roll to reduce adhesion of dross to the steel sheet.

12. Apparatus according to claim 11, wherein said melt flow decelerating means is a rod having a circular cross-section.

13. Apparatus according to claim 11, wherein said melt flow decelerating means is a rod having a non-circular cross-section.

14. Apparatus according to claim 11, wherein said melt flow decelerating means is a plate.

15. Apparatus according to claim 11, including current suppressing means disposed in the plating tank below the sink roll for suppressing melt flows from below the sink roll.

16. Apparatus according to claim 11, including a plurality of snap rolls disposed in the plating tank above the sink roll.

* * * * *